United States Patent [19]

Smith

[11] 4,084,071

[45] Apr. 11, 1978

[54] SWITCH MECHANISM FOR A CALCULATOR TYPE KEYBOARD

[75] Inventor: Theodore Dennis Smith, Indianapolis, Ind.

[73] Assignee: RCA Corporation, New York, N.Y.

[21] Appl. No.: 748,025

[22] Filed: Dec. 6, 1976

[51] Int. Cl.[2] ..... H01H 13/20; H01H 1/06

[52] U.S. Cl. ..... 200/5 A; 200/1 R; 200/67 DB; 200/159 A; 200/159 B; 200/275

[58] Field of Search ..... 200/5 R, 5 A, 16 D, 200/67 DB, 159 R, 159 A, 159 B, 275, 302, 1 R

[56] References Cited

U.S. PATENT DOCUMENTS

| | | | |
|---|---|---|---|
| 3,600,528 | 8/1971 | Leposavic | 200/5 A |
| 3,742,157 | 6/1973 | Leposavic | 200/5 A |
| 3,777,082 | 12/1973 | Hatley et al. | 200/5 A |
| 3,941,964 | 3/1976 | Yoder | 200/5 A |
| 3,952,174 | 4/1976 | Boulanger et al. | 200/5 A |
| 3,973,091 | 8/1976 | Kaminski | 200/5 A |
| 3,979,568 | 9/1976 | Johnson | 200/5 A |
| 3,987,259 | 10/1976 | Larson | 200/5 A |
| 3,996,429 | 12/1976 | Chu et al. | 200/5 A |
| 4,029,916 | 6/1977 | Chu | 200/5 A |

*Primary Examiner*—James R. Scott

*Attorney, Agent, or Firm*—Eugene M. Whitacre; Paul J. Rasmussen; Peter M. Emanuel

[57] ABSTRACT

A calculator type keyboard includes push-button switch mechanisms formed as integral parts of a conductive web. Each of the mechanisms includes support arms intersecting in a crisscross configuration only a portion of which is deformed in a dome-like contour. Contact blades extend from the intersection of the support arms and have ends coupled to adjacent support arms by bridge members. As the switch mechanism is depressed to various degrees, the supported contact blades make contact with respective binary code conductors, the dome-like contour deflects through a snap action position and finally the apex of the dome-like contour makes contact with a centrally located flag contact. Although closure of the contact blades and code conductors is maintained, radial wiping movements of the contact blades across the surfaces of the code conductors occur.

10 Claims, 12 Drawing Figures

| KEY NUMBER | CONDUCTOR | | | | | |
|---|---|---|---|---|---|---|
| | A | B | C | D | F | G |
| 0 | | | | | X | X |
| 1 | X | | | | X | X |
| 2 | | X | | | X | X |
| 3 | X | X | | | X | X |
| 4 | | | X | | X | X |
| 5 | X | | X | | X | X |
| 6 | | X | X | | X | X |
| 7 | X | X | X | | X | X |
| 8 | | | | X | X | X |
| 9 | X | | | X | X | X |

SWITCH MECHANISM FOR A CALCULATOR TYPE KEYBOARD

BACKGROUND OF THE INVENTION

The present invention relates to switch mechanisms for calculator type keyboards. Calculator type keyboards are utilized for a variety of computation and control functions. For example, they have been utilized in a television receiver to permit a viewer to select a particular channel and control such functions as volume, color and tint. Such an application is described in the "XL-100 Color Television — The CTC-74 and CTC-81 Chassis" training manual published by the RCA Corporation, Indianapolis, Ind.

A calculator type keyboard includes an array of push buttons. Typically each push button corresponds to a decimal digit or command. It is often desired that a calculator type keyboard include switch mechanisms which are capable of directly converting decimal digits and commands into binary coded representations rather than indirectly by means of a logic circuit encoder so as to simplify its structure and reduce its cost. To directly encode all the decimal digits from 0 to 9 in, for example, the well-known and often employed binary coded decimal (BCD) format, it is necessary that at least one of the switch mechanisms associated with decimal digits be capable of actuating at least three contact closures when it is operated. In addition, it may be desirable to provide a contact which is closed after the closures of the code contacts in order to generate a signal signifying that data has been correctly entered and is ready for further processing. Further, it is desirable that a push-button switch mechanism with direct encoding features be capable of being simply and economically manufactured and incorporated in a calculator type keyboard, provide a tactile indication of its operation to an operator, and include self-cleaning contacts.

U.S. Pat. No. 3,952,174 discloses an array of solid concave disks, each connected to a thin sheet of conductive material so that they may readily be incorporated into a keyboard. As a disk is depressed it deflects in an "oil-canning" action thereby providing an operator with a tactile indication of its operation. However, because these switch mechanisms are arranged to make contact with only a single conductor, they are not useful for direct binary encoding. Furthermore, because the only motion permitted by the solid disk is along its axis, this switch mechanism does not provide a self-cleaning action.

In copending U.S. patent application Ser. No. 670,800 filed on Mar. 26, 1976 for the same inventor as the present invention, there is disclosed an array of switch mechanisms formed as an integral part of a conductive web so as to be economically manufactured and incorporated in a keyboard. Each switch mechanism includes intersecting support arms extending inwardly from the periphery of a cutout in the web. The support arms are deformed to form a dome-like contour. A plurality of contact blades extend outwardly from the intersection of the support arms. The web is spaced from a circuit board by a spacer with an aperture in general alignment with the switch mechanism. When the dome-like contour of the support arms is depressed, it "oil cans" thereby providing an operator with a tactile indication of its operation. As the contact blades come in contact with associated conductor areas formed on the circuit board, they slide along their surfaces thereby providing a contact cleaning action. The switch mechanism is relatively reliable because of the redundancy afforded by the plurality of contacts. However, because the contact blades cannot be made to consistently make contact at the same time, the mechanism is not particularly suited for direct encoding applications.

U.S. Pat. No. 3,941,964 issued in the name of Alan C. Yoder on Mar. 2, 1976 discloses a calculator type keyboard with individually mounted push-button switch mechanisms which, it is there stated, may be utilized to generate binary coded signals. Each switch mechanism includes a snap action diaphragm switch element having a center contact dimple with outward extending leg members and contact portions inwardly positioned with respect to the leg members. In order to support the diaphragm and provide code contacts at least some of the leg members of each switch mechanism engage terminal pads on the surface of an insulative board. When the switch mechanism is operated the normally opened contact portions are closed and code signals are applied to the terminal pads which engage the leg members. Therefore, to prevent the erroneous application of code signals to the terminal pads which engage leg members of other switch members, each switch mechanism must be electrically isolated from the others and cannot be connected by a common web member. Because the switch mechanism of the Yoder patent are separate units, they require individual placement and therefore are not well suited to be readily and quickly incorporated in a keyboard. Moreover, because in Yoder the legs are not part of the snap action diaphragm and are unsupported by a surrounding web, they do not contribute to any oil-canning effect. Still further, the oil canning deflection of the snap action diaphragm itself is inhibited by the center contact dimple.

SUMMARY OF THE INVENTION

A switch mechanism which may be utilized in a calculator type keyboard includes support arms which extend inwardly from the periphery of an opening in a conductive web to intersect in a crisscross configuration. Only a portion of the crisscross configuration is contoured to define a dome-like shape. Contact blades angularly located between adjacent support arms extend outwardly from the intersection of the support arms. Each of the contact blades is connected to each of its adjacent support arms by bridge members.

DETAILED DESCRIPTION OF THE PREFERRED EMBODIMENT

Figure 1:
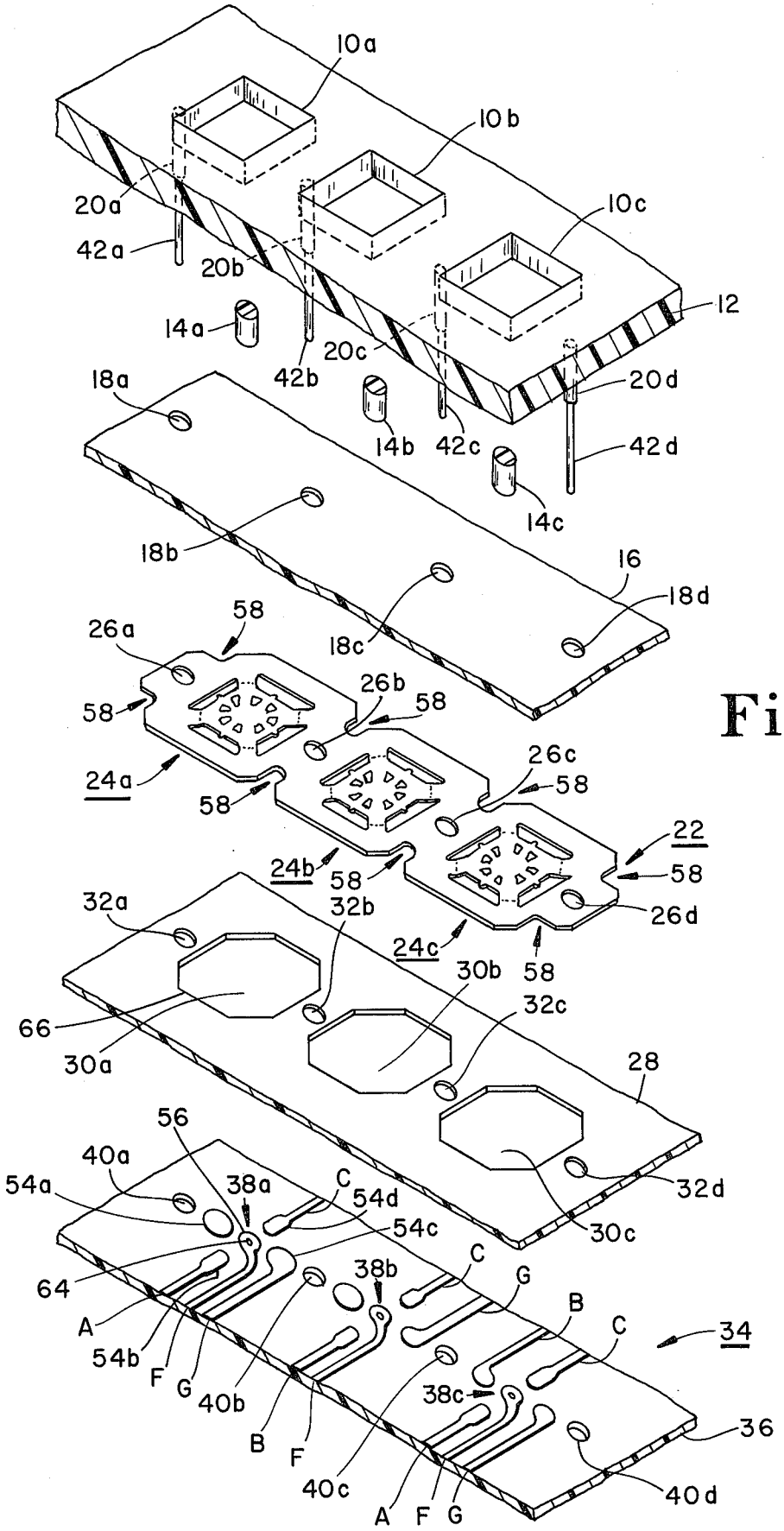
FIG. 1 is an exploded isometric view of a portion of a calculator type keyboard embodying switch mechanisms constructed in accordance with the present invention.

In the keyboard of FIG. 1, three apertures 10*a*, 10*b* and 10*c* are provided through a body 12 for three push buttons (not shown). For clarity of drawing, only urging shafts 14a, 14b and 14c of the push buttons are shown. A flexible fluid and dust shield 16 is located beneath body 12 having guide holes 18a, 18b, 18c and 18d in axial alignment with guide pins 20a, 20b, 20c and 20d. Beneath fluid and dust shield 16 there is located a conductive web 22 partitioned into an array of switch mechanisms 24a, 24b and 24c. Each switch mechanism 24a, 24b and 24c is axially aligned with urging shafts 14a, 14b and 14c. Web 22 also includes guide holes 26a, 26b, 26c and 26d in axial alignment with guide pins 20a, 20b, 20c and 20d. Beneath web 22 there is located a nonconductive spacer 28 having apertures 30a, 30b and 30c in general alignment with switch mechanisms 24a, 24b and 24c. Spacer 28 also includes guide holes 32a, 32b, 32c and 32d in axial alignment with guide pins 20a, 20b, 20c and 20d. Beneath spacer 28 there is located a circuit board 34 comprising a dielectric material 36 upon which are formed conductors ending in contact pads arranged in groups 38a, 38b and 38c in general alignment with switch mechanisms 24a, 24b and 24c of conductive web 22. Circuit board 34 includes guide holes 40a, 40b, 40c and 40d in axial alignment with guide pins 20a, 20b, 20c and 20d. Guide pins 20a, 20b, 20c and 20d have ends 42a, 42b, 42c and 42d, the bottom tips of which fit into guide holes 40a, 40b, 40c and 40d of circuit board 34. The length of the ends 42a, 42b, 42c and 42d of guide pins 20a, 20b, 20c and 20d are selected so that conductive web 22 and spacer 28 are snugly but not immovably held between the bottom ends of guide pins 20a, 20b, 20c and 20d and the top surface of circuit board 34 for the reasons set forth below.

Although body 12 includes walls and other support members which form the complete structure of the keyboard, these portions have been omitted from FIG. 1 to more clearly show the present switch mechanism.

Because each of the switch mechanisms 24a, 24b and 24c are identical, only switch mechanism 24a and its associated contact pad group 38a will be described in detail. Concurrent reference to FIGS. 1 and 1a should now be made. Switch mechanism 24a includes support arms 44a and 44b which extend diagonally inward from the corners of the periphery 46 of a square cutout portion of web 22 and intersect in a crisscross configuration. The intersection of support arms 44a and 44b is in axial alignment with shaft 14a. A portion 45 of the crisscross configuration inward of periphery 46 of the cutout portion is contoured to form a dome-like shape, the extent of which is defined by a border 60. The remaining portions of support arms 44a and 44b lie in the plane of web 22. Contact blades or fingers 48a, 48b, 48c and 48d extend radially outward from the intersection of support arms 44a and 44b between adjacent portions thereof. The outer ends of contact blades 48a, 48b, 48c and 48d are connected by bridge members 50 to the portions of support arms 44a and 44b adjacent them. The tips of contact blades 48a, 48b, 48c and 48d extend slightly beyond bridge members 50. Contact points or dimples 62a, 62b, 62c and 62d, directed downwardly toward circuit board 34, are formed on the tips of contact blades 48a, 48b, 48c and 48d. The contact points 62a, 62b, 62c and 62d are in alignment with respective contact pads 54a, 54b, 54c and 54d of group 38a on circuit board 34. Furthermore, a center contact pad 56 of circuit board 34 is in alignment with the apex of dome-like portion 45 of switch mechanism 24a. A crater-like depression having a raised rim (see FIGS. 2a–4c) is located on center contact pad 56 so as to provide a contact surface for the apex of dome-like portion 45 which has relatively low contact resistance and which will not readily support foreign matter, as is further explained in copending United States patent application Ser. No. 748,026 entitled, "Contact for Calculator Type Keyboard Including a Printed Circuit Board", concurrently filed in the name of the same inventor as the present inventor, hereby incorporated by reference. Each of the switch mechanisms 24a, 24b and 24c are partitioned from the others by boundary lines having ends terminating in cut-away portions 58.

Figures 1A, 5:
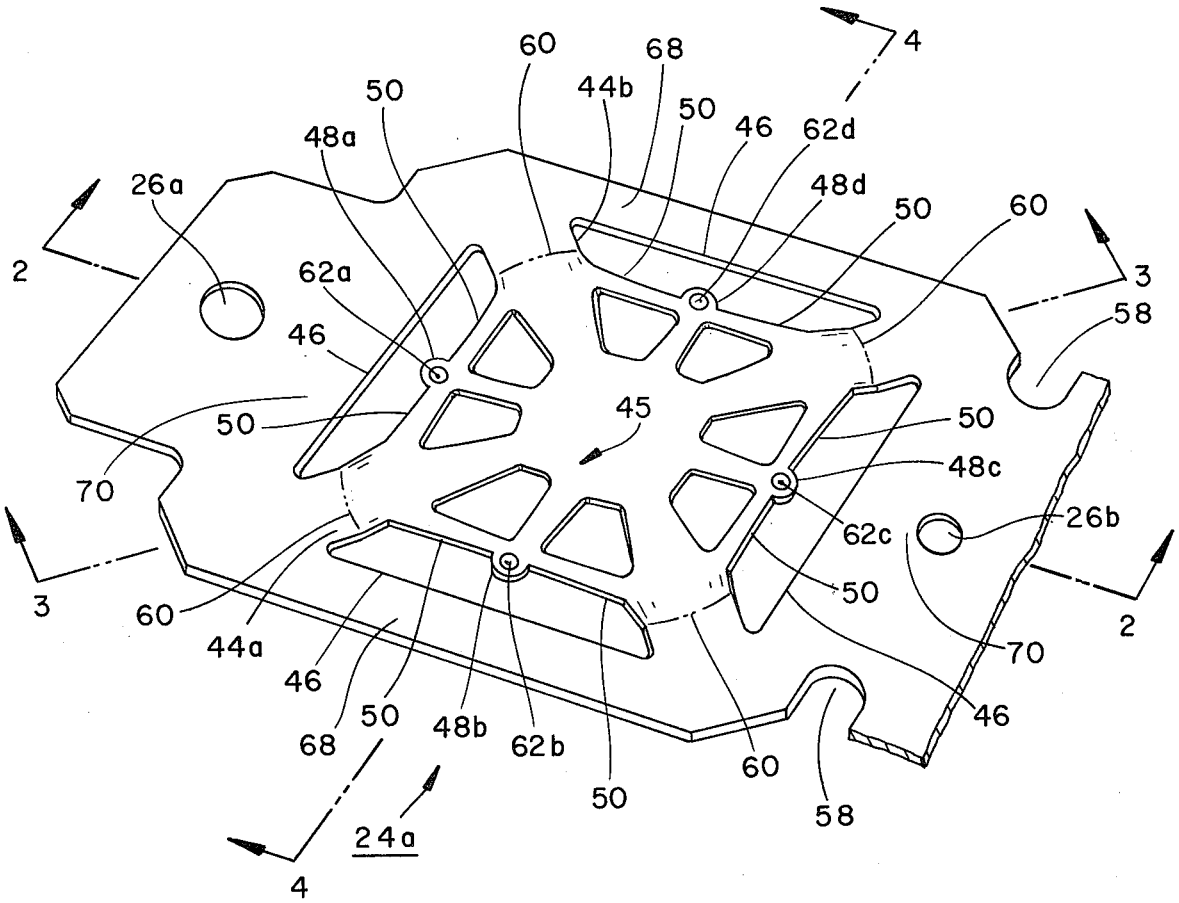
FIG. 1*a* is a detail view of a portion of the switch mechanism of FIG. 1.
FIG. 5 is a table indicating the binary coded representations produced by the operation of various switch mechanisms of FIG. 1.
Figure 2A:
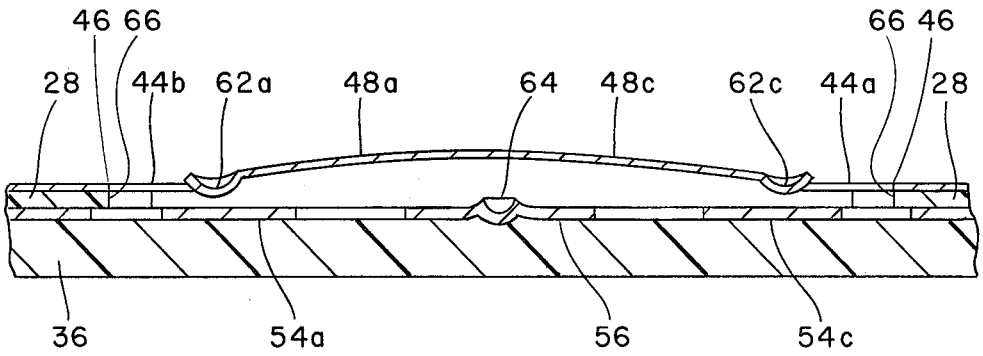
FIGS. 2*a*, 2*b*, 2*c*, 3*a*, 3*b*, 3*c*, 4*a*, 4*b* and 4*c* are cross-sectional views of the switch mechanism and associated portions of the keyboard of FIG. 1 in various operating positions.
Figure 2B:
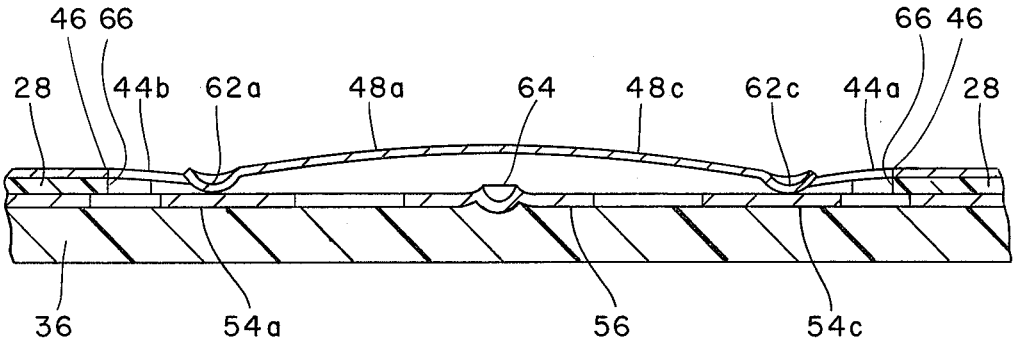
Figure 2C:
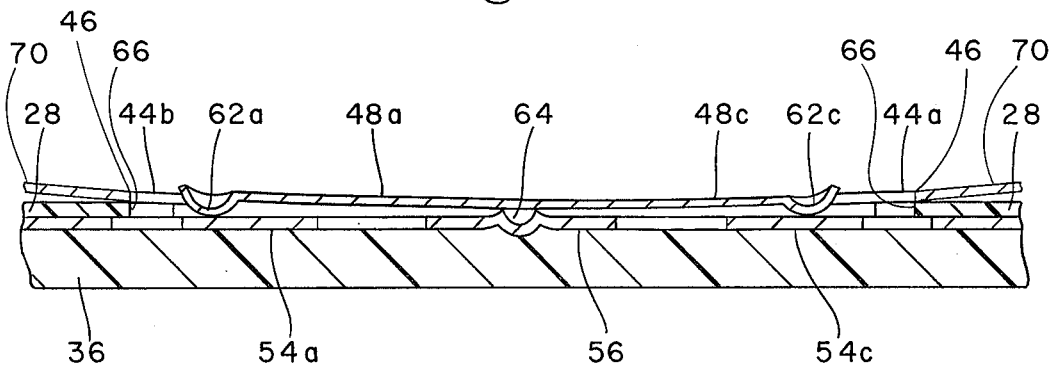
Figure 3A:
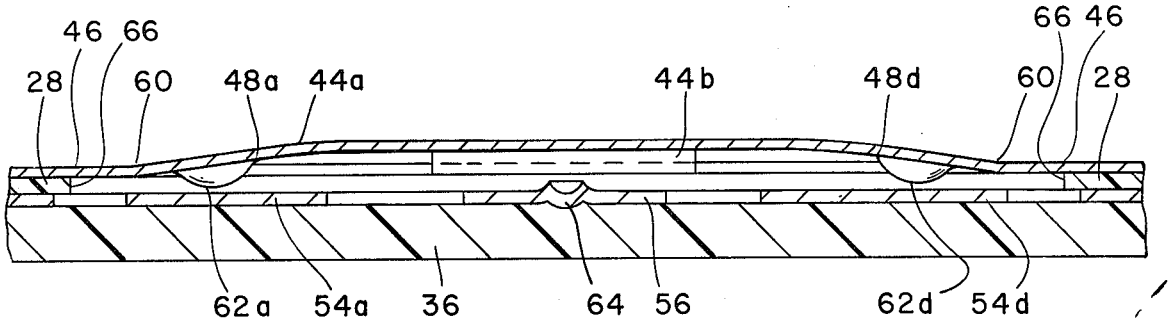
Figure 3B:
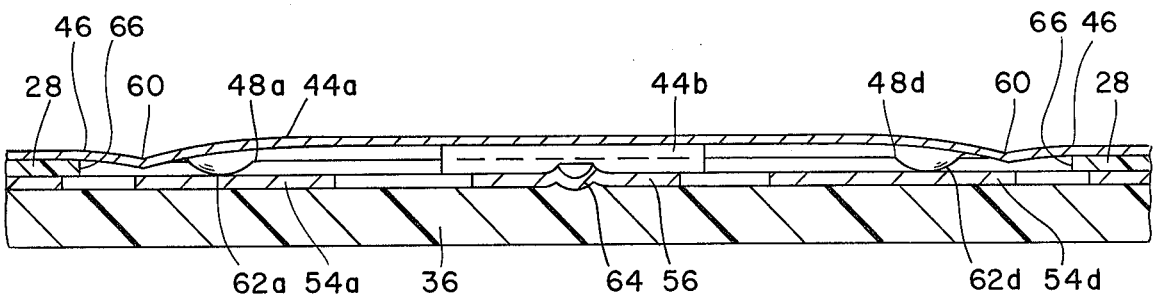
Figure 3C:
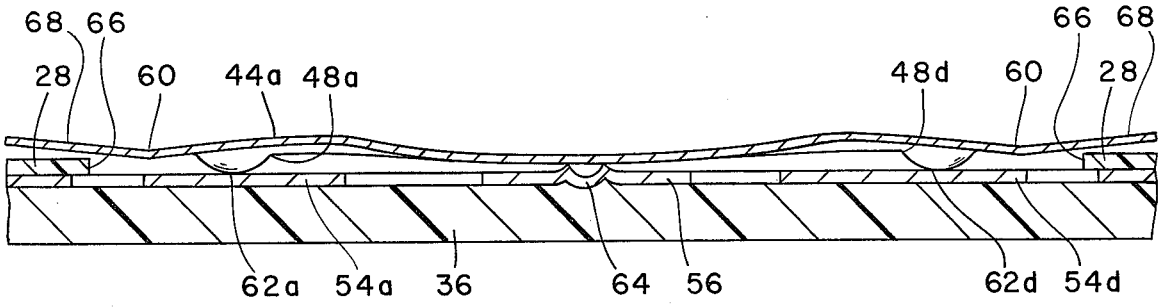
Figure 4A:
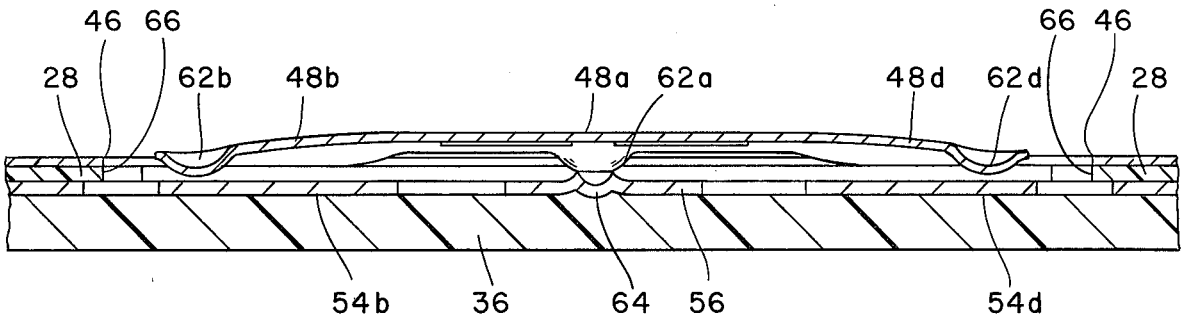
Figure 4B:
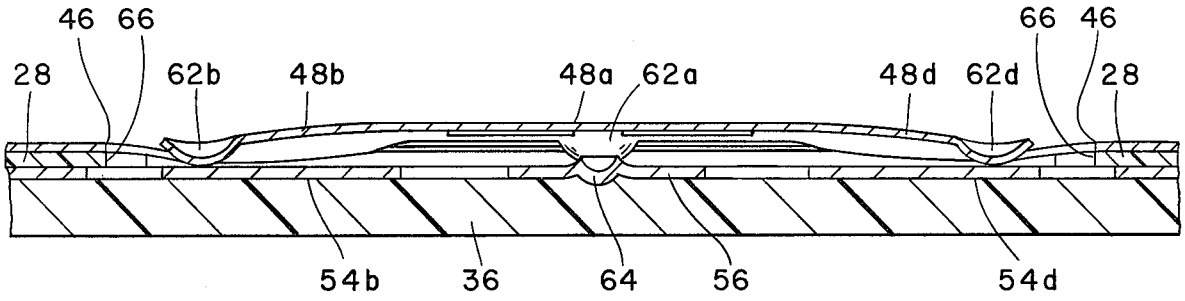

The operation of the switch mechanism 24a will best be understood by reference to FIGS. 2a–2c, 3a–3c and 4a–4c which are cross-sectional views taken in the direction of section lines 2—2, 3—3 and 4—4 of FIG. 1a. It will be understood that shaft 14a is depressed to various degrees to provide the deflections shown in FIGS. 2a–2c, 3a–3c and 4a–4c. In FIGS. 2a, 3a and 4a, the normal or rest position of switch mechanism 24a is shown. In FIGS. 2b, 3b and 4b switch mechanism 24a is shown after the application of a force sufficient to bring contact blades 48a–48d into contact with conductor pads 54a–54d. Contact points 62a–62d of contact blades 48a–48d makes contact with conductor pads 54a–54d essentially at the same time. This is so because bridge members 50 insure that contact blades 48a–48d move downward toward circuit board 34 together. To further enhance this uniformity of contact closure, periphery 60 of dome-like portion 45 is radially inward from periphery 46 of the cutout portion of the web 22 from which support arms 44a and 44b extend inwardly. Periphery 46 of the cutout portion of web 22 is substantially juxtaposed with periphery 66 of aperture 30a of spacer 28. Therefore, support arms 44a and 44b are able to bend at periphery 46. As a result, contact blades 48a–48d come into contact with conductor pads 54a–54d before there is any significant "oil canning" deflection of dome-like portion 45 of switch mechanism 24a, as will be explained, which may otherwise prevent one or more of contact blades 48a–48d from making contact with its respective contact pad 54a–54d.

While it may be thought that the spoked wheel-like structure of switch mechanism 24a may be completely filled in with material to form a solid dome with contact blades extending from its periphery, it has been found in such a solid configuration that one or more of the contact blades can lift from its respective contact pad while other contact blades are still in contact with their respective contact pads because of its rigidity. This may be understood by considering the difficulty of trying to balance a four legged table with uneven legs.

Figure 4C:
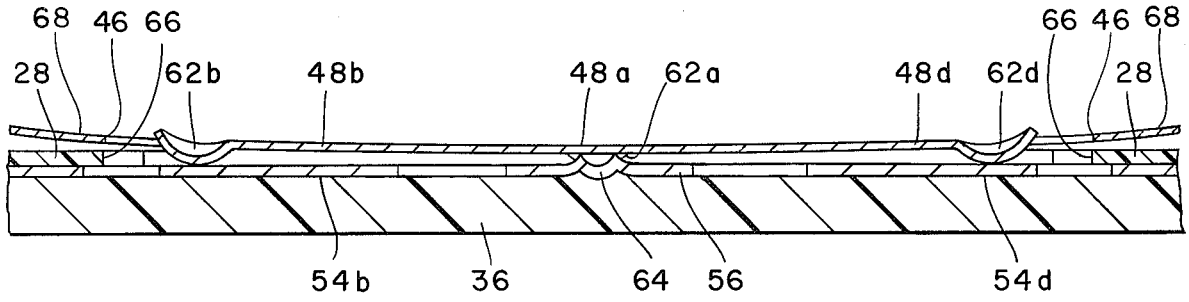

FIGS. 2c, 3c and 4c show the position of switch mechanism 24a when it is fully depressed. It is shown that the apex of dome-like portion 45 is in contact with the edge of contact area 64 of center conductor pad 56. At this point of the operation, the apex of the dome-like portion has passed through the plane of the top surface of spacer 28 thereby producing an "oil canning" effect. The "oil canning" takes place after contact blades 48a–48d have made contact with conductor pads 54a–54d. As switch mechanism 24a is further depressed, dome-like portion 45 trys to flatten out causing support arm 44a–44d to be forced outwardly away from the apex. This causes web 22 to try to expand. However, since web 22 is constrained in the form of a closed loop by end portions 68 and 70, it cannot expand and instead deflects into a reverse curvature contour along with dome-like portion 45 to produce an "oil canning" effect as shown in FIGS. 2c, 3c and 4c. When the "oil canning" takes place, the operator feels a sudden release of the stresses in switch mechanism 24a, sometimes called a "snap action", at his fingertip providing him with a tactile indication that the switching action is taking place.

It has been found desirable to enhance the "oil canning" effect, to permit end portions 68 and 70 of switch mechanisms 24a, 24b and 24c to lift up slightly, as shown in FIGS. 2c, 3c and 4c, when switch mechanisms 24a, 24b and 24c are depressed. To this end, in the embodiment of FIG. 1, guide holes 26a–26d of web 22 are located in the center of the areas on each side of switches 24a, 24b and 24c to receive guide pins 26a–26d so that end portions 68 of web 22 can lift up during the operation of switch mechanisms 24a, 24b and 24c. Furthermore, guide pins 20a–20d are dimensioned so that their end portions 42a–42d allow end portions 70 of web 22 to move slightly in the vertical direction.

To provide some degree of mechanical isolation between switch mechanisms 24a, 24b and 24c without completely separating them, cutouts 58 are desirably located at the ends of the boundary lines between switch mechanisms 24a, 24b and 24c. Completely separated switch mechanisms are undesirable since they require individual manufacture and placement thereby increasing the cost of the keyboard. Moreover, separate switch mechanisms may become dislodged requiring the keyboard to be repaired. Because of cutouts 58, the respective outer portions 68 of web 22 bordering each switch mechanism 24a, 24b and 24c may separately lift up during its operation without interference from the structure of the adjacent switch mechanism.

FIGS. 2c, 3c and 4c also show that contact blades 48a–48d have been maintained in contact with contact pads 54a–54d although contact points 62a–62d of contact blades 48a–48d have been longitudinally moved with respect to their positions shown in FIGS. 2c, 3c and 4c across the surfaces of pads 54a–54d. This longitudinal movement cleans the contact areas and insures relatively low electrical contact resistances for a relatively large number of switch operations. Furthermore, by comparing FIGS. 2c, 3c and 4c with FIGS. 2b, 3b and 4b, it is seen that a last contact, i.e., the one associated with center conductor pad 56, is closed only after the closure of all the other contacts. Such an arrangement is desirable since it may be utilized to generate a flag signal indicating that all other contacts are closed, in response to which data can be reliably entered.

Bridge members 50 are dimensioned so that they are rigid enough to insure that all of the contact blades 48a–48d make and maintain contact with conductor pads 54a–54d before the apex of the dome-like shape makes contact with center conductor pad 56, yet flexible enough to permit contact points 62a–62d to wipe across conductor pads 54a–54d.

Although the switch mechanisms of web 22 are arranged in a row array, a rectangular array of switch mechanisms may also be constructed in accordance with the present invention. In this case, it is desirable that cutouts similar to 58 be located at the ends of the boundaries between switch mechanisms in the row direction as well as in the column direction.

The table of FIG. 5 indicates a format of binary signals which may be used to encode the decimal digits between 0 and 9. An "X" represents a contact closure between a contact of a switch mechanism and a respective conductor. Conductors A, B, C and D are associated with particular BCD code positions: A with $2^0 = 1$; B with $2^1 = 2$; C with $2^2 = 4$; and D with $2^3 = 8$. Up to three of the conductors A, B, C and D may be positioned to be contacted by contact blades of a switch mechanism. Conductor G is coupled to a source of fixed potential such as ground or +5 VDC and is positioned to be contacted by at least one contact blade of a switch mechanism. Conductor F is associated with the generation of a flag signal to indicate that all of the contact blades of a switch mechanism have made contact with their respective conductors so that data may be entered and is positioned to be contacted by the apex of the dome-like shape. Assuming that switch mechanism 24a corresponds to decimal digit 5, switch mechanism 24b corresponds to decimal digit 6 and switch mechanism 24c corresponds to decimal digit 7, conductors A, B, C, D, F and G may be arranged as shown in FIG. 1 to provide the BCD and flag signals for the decimal digits 5, 6 and 7. With this arrangement, assuming that conductor G is coupled to +5 VDC, when switch mechanism 24a is depressed, +5 VDC level (i.e., a logic "high") is applied to conductors A and C. Thereafter, when the apex of dome-like portion 45 contacts center conductor 56, a flag signal is generated.

It will be noted that because the fixed potential is applied to the BCD code conductors upon the closure of an appropriate conductor blade and conductor G, it is not necessary to wire web 22 to the source of fixed potential, thereby reducing the discrete wiring utilized in the keyboard. Under these conditions, only three contact blades are available for generating the BCD signals. However, since only a maximum of three closures (for decimal digit 7) are needed to represent the decimal digits in BCD format, this is satisfactory. Should it be desired to additionally generate signals representing the decimal digits from 10 to 16, the contact blade associated with conductor G could be used as a fourth code contact blade. In this case, web 22 should be wired to the source of fixed potential.

What is claimed is:

1. A keyboard switch assembly, comprising:

a generally planar conductive web;

at least one moveable switch contact mechanism formed as an integral part of said web including support arms extending inwardly from the periphery of an aperture in the web to intersect in a criss-cross configuration; a portion only of said criss-cross configuration being contoured away from the plane of the web to form a dome-like shape so that portions of said support arms lie in the plane of said web; contact blades extending outwardly from the intersection of said support arms; and bridge members connecting the outer ends of said contact blades to adjacent portions of said support arms;

a circuit board having at least one group of conductor pads in general alignment with the outer ends of the contact blades of said moveable switch contact mechanism; and a dielectric spacer located between said web and said circuit board and having at least one aperture in general alignment with the aperture of said web and being dimensioned so that the planar portions of said support arms extend over the periphery of the aperture of said spacer.

2. The apparatus recited in claim 1 wherein said web includes an array of at least two of said moveable switch contact mechanisms, said moveable switch contact mechanisms being partitioned from one another by a boundary area having ends termininating in a cutout portion of said web so as to provide a degree of mechanical isolation between said moveable switch contact mechanisms.

3. The apparatus recited in claim 2 wherein holding means are located between said moveable switch contact mechanisms in said boundary area.

4. The apparatus recited in claim 3 wherein said holding means snugly but not immovably holds said web in contact with said spacer so that said web may move slightly in a direction generally perpendicular to the plane of said circuit board during the operation of said moveable switch contact mechanism.

5. The apparatus recited in claim 4 wherein said holding means includes a guide pin extending in a generally perpendicular direction from said circuit board to be received by a guide hole located in said web between said switch mechanisms, said guide pin having a portion with a length dimensioned to permit movement of said web in a predetermined range in the direction of the axis of said guide pin.

6. The apparatus recited in claim 3 wherein contact points are formed in the outer ends of said contact blades.

7. The apparatus recited in claim 3 wherein said group of conductor pads includes a center conductor pad in alignment with the apex of said dome-like shape.

8. The apparatus recited in claim 7 wherein at least one of said conductor pads associated with said contact blades is coupled to a conductor for carrying a binary code signal.

9. The apparatus recited in claim 8 wherein said center conductor pad associated with the apex of said dome-like shape is coupled to a conductor for carrying a flag signal indicating that all of said conductor blades have made contact with their respective conductor pads.

10. The apparatus recited in claim 9 wherein at least one of said conductor pads associated with said contact blades is coupled to a source of fixed potential.

* * * * *